US006789339B2

(12) United States Patent
Blease

(10) Patent No.: US 6,789,339 B2
(45) Date of Patent: Sep. 14, 2004

(54) ILLUMINATED MESSAGE DISPLAY PREDOMINANTLY FOR AUTOMOBILES

(76) Inventor: Janis Blease, 10603 E. Black Forest Dr., Parker, CO (US) 80138

( * ) Notice: Subject to any disclaimer, the term of this patent is extended or adjusted under 35 U.S.C. 154(b) by 0 days.

(21) Appl. No.: 10/138,817

(22) Filed: May 6, 2002

(65) Prior Publication Data

US 2003/0204979 A1 Nov. 6, 2003

(51) Int. Cl.[7] ..... G09F 21/04

(52) U.S. Cl. ..... 40/593; 40/597; 362/503; 362/504

(58) Field of Search ..... 40/597, 593, 556, 40/575; 362/488, 503, 504

(56) References Cited

U.S. PATENT DOCUMENTS 3,905,017 A * 9/1975 Samra ..... 40/556
4,575,782 A * 3/1986 Levine et al. ..... 362/503
5,016,145 A * 5/1991 Singleton ..... 362/503
5,746,498 A * 5/1998 Rogge ..... 362/488
6,154,994 A * 12/2000 O'Brien et al. ..... 40/575
6,282,824 B1 * 9/2001 Noll et al. ..... 40/593
6,367,182 B1 * 4/2002 Olson, Jr. ..... 40/593
6,446,375 B1 * 9/2002 Davis ..... 40/597

* cited by examiner

*Primary Examiner*—Gary Hoge

(57) ABSTRACT

The apparatus is an internally illuminated message display, predominantly for an automobile, and is readily adaptable for any window display. The apparatus comprises of a cylindrical lightweight molded plastic housing, with an interior reflective paint or reflective material, a light socket and light bulb. A snap on sleeve contains a slot for the insertion of a translucent disk. Said disk contains various messages and/or art symbols. The sleeve has a hinge connecting it to an adjustable oval transparent suction cup frame. The oval transparent suction cup attaches to the frame and spans the face of the display with the lip of the suction cup circumnavigating the outer edge of the frame. Hinged adjustment is made for attachment to an aerodynamic sloping automobile rear window, and is stabilized with a snap on rod from sleeve to suction cup frame. The gap created from adjustment between the sleeve and frame is covered with an opaque thin snap on plastic sock.

5 Claims, 5 Drawing Sheets

ILLUMINATED MESSAGE DISPLAY PREDOMINANTLY FOR AUTOMOBILES

FIELD OF INVENTION

This invention relates to illuminated displays for windows, more particularly circular displays for automobile rear windows, and can be adjustable to aim horizontally when installed on sloping aerodynamic automobile rear windows. The invention is extremely lightweight molded plastic that snaps together and provides instantaneous installation that is stronger, more secure, and more stabilizing.

BACKGROUND OF THE INVENTION

Automobile signs, bumper stickers, and illuminated signs have been popular and utilized to varying degrees for novelty, advertisement, or personal expression since the birth of the automobile. Previous illuminated automobile signs have been mounted on either the interior or exterior of the automobile. Interior automobile signs have been cumbersome, impractical, intrusive, and complicated in their assembly and mounting. In addition they often block the operator's vision.

DESCRIPTION OF PRIOR ART

An example of impractical and intrusive mounting being U.S. Pat. No. 6,178,677 by Williams, Jan. 30, 2001 having an illuminated rectangular floor mounted apparatus (FIG. 1) which would not be suitable for Suburban Utility Vehicles (SUVs) or mini vans; as these automobiles do not have rear window dashes which would support said floor mounting. The floor mounting (FIG. 2) also requires drilling holes into the rear dash, and compromising the integrity of the dash itself, for upon the removal of said apparatus, holes are left in the rear window dash.

Other examples of a disadvantage are the use of small suction cups in the attachment of the apparatus, which allows for 'free swinging' from lower mounting, or above hanging of said apparatus. Two examples of this being U.S. Pat. No. 5,016,145 by Singleton, May 14, 1991 (FIG. 2) and U.S. Pat. No. 5,822,900 by Armstrong, Oct. 20, 1998 (FIG. 1).

All illuminated display apparatus known to the applicant have a display face that is square, or rectangular in shape; while none have a display face that is uniquely round.

The small suction cups are impractical as they are more subject to loosing there suction through the dynamics of automobile usage. Said dynamics being the heavy weight of the apparatus, the change in temperature and barometric pressure, and the constant tugging from vibration, centrifugal force and inertia from an automobile's constant turning, starting and stopping. The back and forth swaying of the upper, or lower half of the apparatus would cause it to bump into the rear window, causing distressing noise, and actual damage to the automobile rear window and the apparatus itself. When the small suction cups fail completely, the apparatus will drop, which could cause damage to either it or the automobile.

Furthermore, the housing of existing apparatus is heavy, and complicated in its assembly, requiring tools and instruction for its assembly, operation, and use.

Applicant is unaware of any device and/or prior art as it pertains to a suction cup that uniquely frames the entire face and embodiment of the housing for any illuminated display apparatus, and radiates another designated amount beyond said frame and housing.

Prior art, as it pertains to suction cup adhesion, all contain various proximal arrangements for attachment to various apparatus. Such arrangements being: U.S. Pat. No. 5,645,254 by Ng et al., Jul. 8, 1997, having a cylindrical proximal end containing a bifurcated channel for receiving a portion of a garland. U.S. Pat. No. 5,402,974 by Williams, Apr. 4, 1995 having a cylindrical proximal holding portion which has a slit opening for reception of a wire or hook. U.S. Pat. No. 5,110,078 by Gary, May 5, 1992 having a proximal end with a socket support member. U.S. Pat. No. 1,922,900 by Plante, Aug. 15, 1933 having a suction cup with a proximal knob that supports a wire hook element. U.S. Pat. No. 1,575,789 by Phelps, Mar. 9, 1926, having a suction cup with a proximal knob that supports a bracket.

All suction cup apparatus known to the applicant, treat the suction cup as a separate entity from the apparatus; and none treat the suction cup as an integrally incorporated part of the entire apparatus.

SUMMERY OF THE INVENTION

With respect to foregoing disadvantages inherent in known illuminated rectangular automobile displays, as described in 'prior art', it is the objective of the invention to provide totally unique and new improvements, overcoming all said difficulties with an innovatively circular, stronger, and better adjustable design, without visual impairment.

The device provides a form of personal expression, being the illumination of flashed messages such as, 'thank you," or a happy face to fellow automobile operators; or a continual illuminated message conveying patriotisms, religious or sporting affiliation, and artwork.

It is to be known that said invention is not limited in it's application to automobile rear windows, but can be modified in arrangements and components to be adaptable to all window or glass, Plexiglas, transparent plastic, and electrical systems. In addition, it is to be known that said invention is not limited strictly to a circular shape for the illuminated face and suction cup frame; but can be modified in shape to be adaptable to other similar geometrical shapes that are consistent with the properties necessary to maintain suction to a smooth surface. Phraseology, terminology, and descriptions as used in this document should not be interpreted as limiting or absolute; but should be appreciated for the conceptual and unique ideas of the present invention; insofar as the applications do not depart from the scope and spirit of said invention.

Such an example might be the use of a 120-volt system for the device to be used on other window and/or glass surfaces. Another example might be the use of the device without the adjustable hinge for specifically mini-vans or suburban utility vehicles that have flat back windows. A final example might be the use of the frame for displays without the illuminated housing.

1. It is the objective to provide a new and improved illuminated automobile display apparatus with a cylindrical housing and circular face which has advantages beyond the scope of its' predecessors.

2. Again it is the objective to provide a molded plastic housing, avoiding the need for assembly, and enhancing the need for a lightweight apparatus.

3. Again it is the objective to provide a simple snap on molded plastic sleeve, to avoid the need for tools, nuts and bolts, and the inherent problems associated with small multiple parts assembly.

4. Again it is the objective to provide where needed, plastic buttons and button holes for easy snap on assembly of the stabilizing bar, and sock attachments.

5. Again it is the objective to provide an all-new concept for suction cup adhesion to a smooth automobile rear window. Said transparent suction cup adhesion will no longer be a 'hooked on' attachment; but will frame the entire face of the housing, and radiate another designated amount beyond the frame and housing. Said suction cup will create a suction incorporating the face of the lightweight housing. This is in strength approximately eight fold stronger than the known suction cup devices in use today. Using rounded numbers, two attached suction cups with a two inch diameter would produce a vacuum surface of 6¼ square inches; whereas the new suction cup with a display area having a six inch face and a one inch lip would have a total of over fifty square inch area of suction, or approximately eight times the vacuum strength of all previous devices. This stronger newly designed use of a suction cup would solidify the entire face of the apparatus, thus eliminating all free swinging movements due to vibration, inertia, or centrifugal force. This new design would greatly minimize suction cups from being compromised.

6. Again it is the objective to provide an eight-fold enhancement of suction cup strength, while eliminating excess weight to eliminate the deleterious effects of temperature, vibration, and barometric pressure causing the failure of the suction cups.

7. Again it is the objective to provide an easy assembly, window mounted invention that would also be horizontally adjustable when mounted on a slopping aerodynamic automobile window. Said adjustment would be from horizontal to a 30 degree or more slant, thus providing usage by automobiles with aerodynamically slanted rear windows.

BRIEF DESCRIPTION OF THE DRAWINGS

These drawings add a better perceptual understanding of the embodiment of the illuminated message display apparatus for an automobile.

DESCRIPTION OF THE PREFERRED EMBODIMENT

Definitions: The distal end of the apparatus is defined as that end in FIG. 1 which lies to the left of the page, comprised of the vertical wall holding the light socket. The proximal end of the apparatus is defined as that end in FIG. 1 which lies to the right of the page, comprised of the illuminated face and the suction cup frame. The ceiling of the apparatus is defined as that end in FIG. 1 which is at the top of the page, comprised of that part of the frame with the hinge. The floor of the apparatus is defined as that end in FIG. 1 which is at the bottom of the page, comprised of that part of the frame, which is 180 degrees from the hinge.

Figure 1:
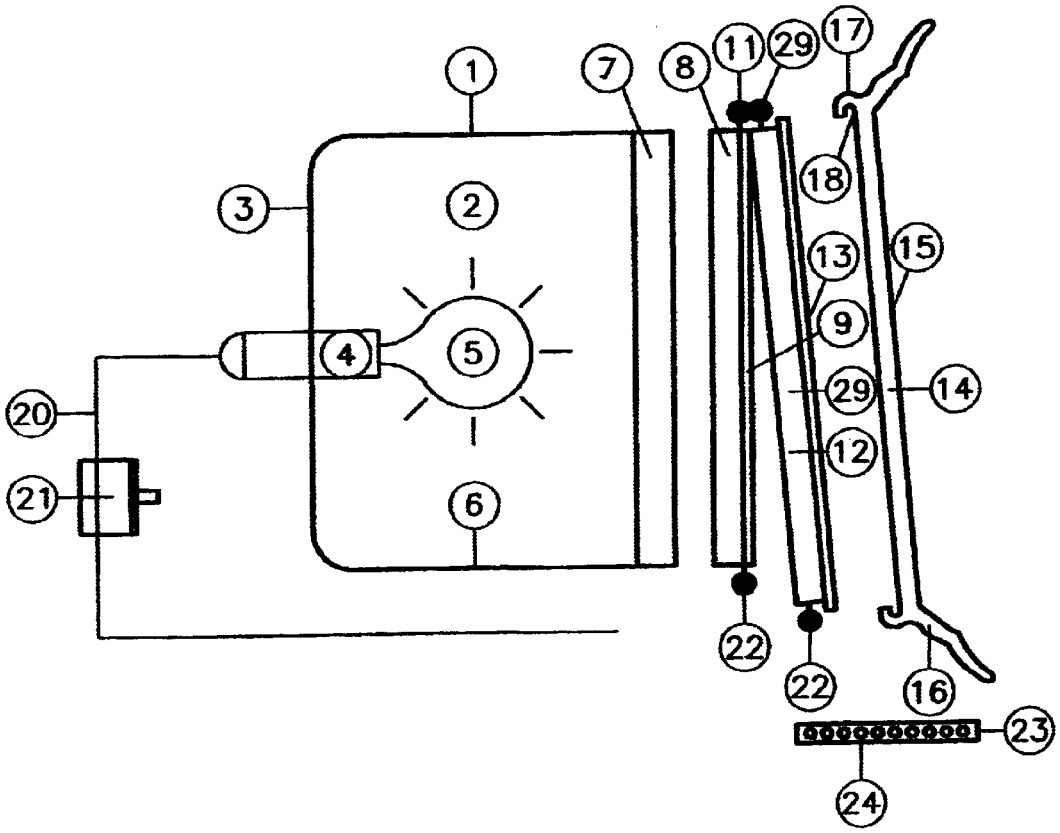
FIG. 1 is a cut-away schematic of the entire embodiment.

FIG. 1 is a detailed cut-away of the entire assembly, showing the molded plastic assembly 1, consisting of a cylindrical housing 2, and a closed wall 3. The interior of the housing has a reflective paint or reflective material 6, and is fitted with a light socket 4, centered on the closed wall 3. The centered light socket 4 is fitted with a light bulb 5. The opened end of the cylindrical housing is a ridged sleeve 7, for the slide-on attachment of a snug outside slide-on ridged sleeve 8. The outside slide-on ridged sleeve 8 has a loading slot 9 for the translucent art disk 10 to be inserted.

The outside slide-on ridged sleeve 8 has a hinge 11, which would comprise the ceiling of the apparatus, and would connect the apparatus to an oval suction cup frame 12. The hinge 11 would create a floor of the apparatus at 180 degrees from the hinge 11. The floor of the apparatus, on the outside slide-on ridged sleeve 8, and the oval suction cup frame 12, has snap on buttons 22 for the flat plastic snap on support rod 23. The flat plastic snap on support rod 23 has holes for multi-adjustments 24, which span the full length of the rod. The hinge, rod, and snap on buttons are all used for the adjustment of the apparatus when it is put on an aerodynamic rear window of an automobile. This allows for the suction cup 14, and suction cup frame 12, to be at an angle, while the plumbed housing 2, and translucent art disk 10, are always vertical for optimum viewing. The oval suction cup frame 12, is oval and not round to allow for the lost viewing space when the suction cup frame 12 is placed on an aerodynamic window and at an angle from the plumbed round outside slide on ridged sleeve 8.

The ridge on the suction cup frame 13 is for mounting the suction cup 14, and runs the entire outer circumference of the suction cup frame 13; as does the 'C' shaped counter ridge 18 on the translucent suction cup 14 run an entire circle, demarking the center 'face' of the suction cup 14 from the outer lip 16, and is the same circumference as the suction cup ridged frame 13. The 'C' shaped counter ridge 18 on the suction cup is stretched up and over the oval suction cup ridged frame 13 onto the oval suction cup frame 12, thus locking it into place. The oval suction cup frame 12 surrounds the face of the suction cup 15, and the outer lips of the suction cup 16 are thicker at the base and thinner at the edge. The outer suction cup lip 16 is also convex on the non-sticking outside edge and concave on the inside sticking edge for maximum suction capability.

Snap on buttons 29 line the outer edge of the oval suction cup frame 12, and are used to secure the wrap around sock 25 to the oval suction cup frame 12. The snap on buttons 29 are placed at the ceiling and floor of the apparatus and at 90-degree angles of same.

The power cord 20 extends from the centered light socket 4, to a generic on off switch 21, and then to an electrical source.

Figure 2:
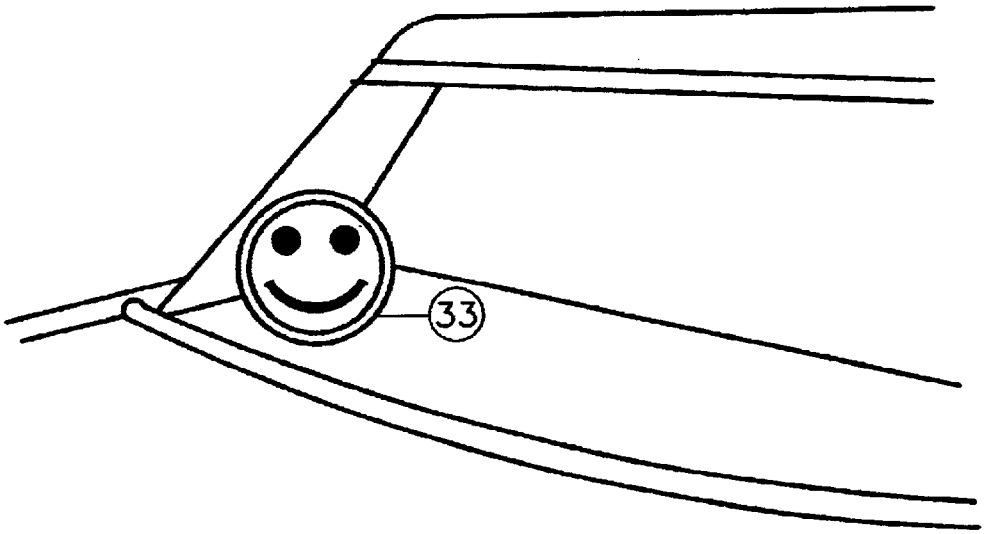
FIG. 2 is a perspective view of how the illuminated message display apparatus might look in the rear window of an automobile.
Figure 3:
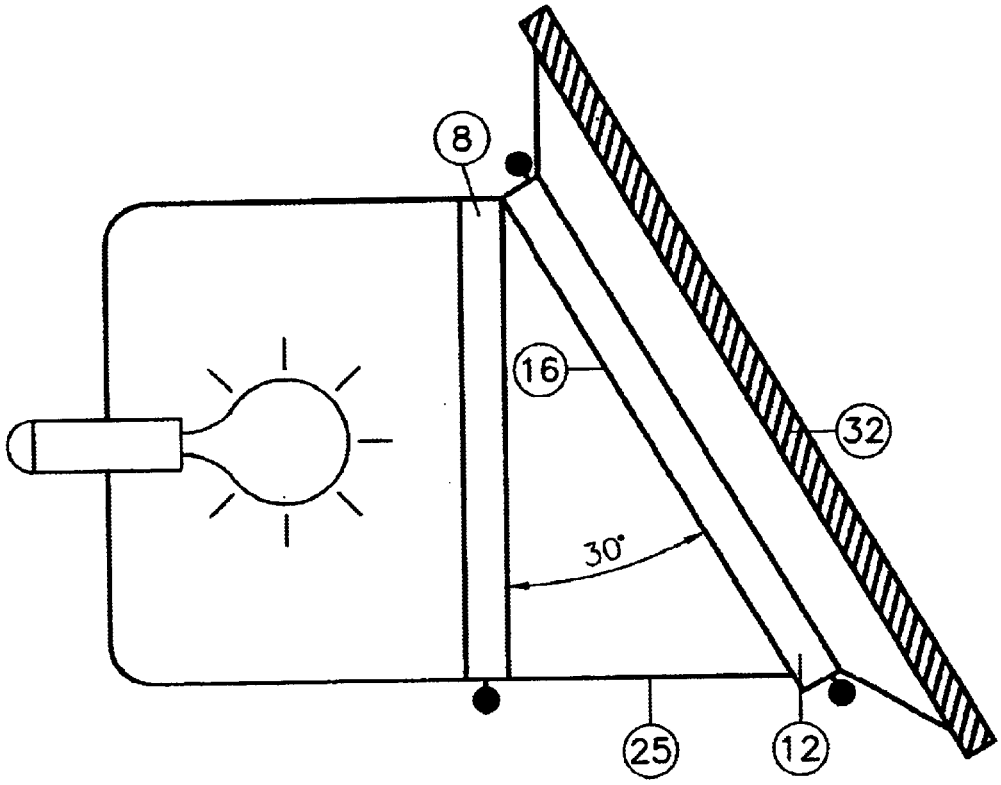
FIG. 3 is a cut-away view showing the embodiment attached and adjusted to a slanted aerodynamic rear window of an automobile.

FIG. 2 The Invention, in the rear window of an automobile 33, as it appears to a pedestrian, or driver behind the designated automobile, FIG. 3 shows exactly how the apparatus would look in an adjusted state when attached to an aerodynamic rear window. Said face of cylindrical housing is plumbed to a 90-degree vertical angle and locked in place by the flat plastic snap on support rod 23, which is snapped onto both the outside slide on ridged sleeve 8, and the oval suction cup frame 12. The sock 25 is shown in place, having been rapped around the gap 30, created between the sleeve and frame, which was formed when the adjustment was made. The suction cup oval lip 16 is attached to the window glass 32.

Figure 4:
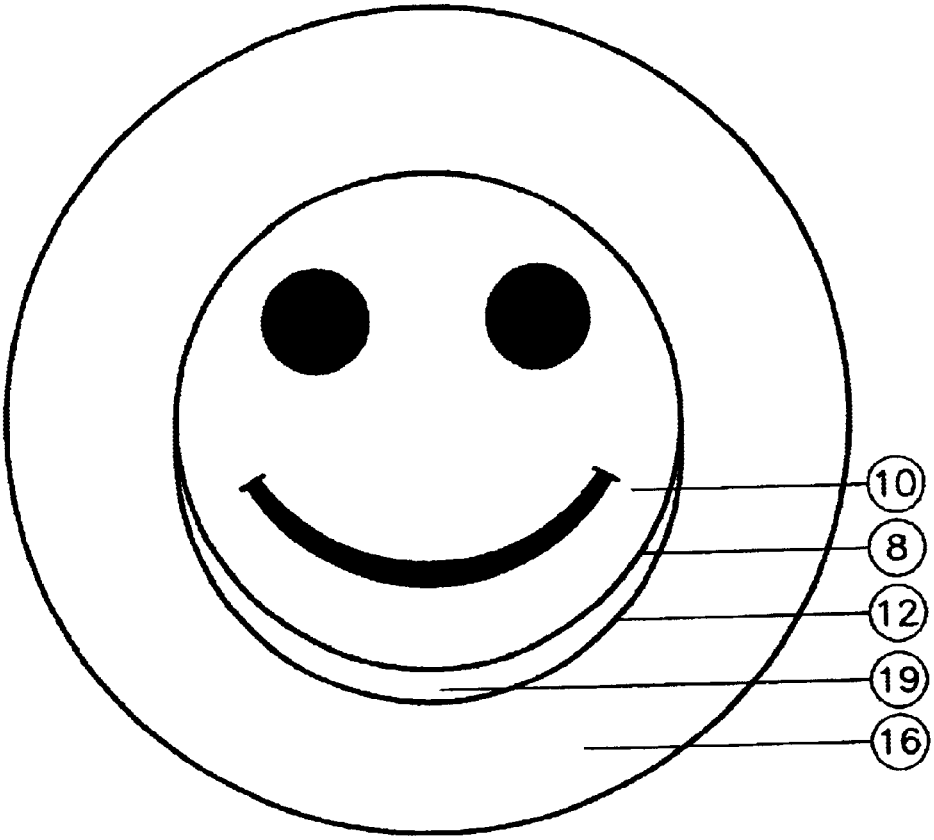
FIG. 4 is a front view of the embodiment.

FIG. 4 is the front view of the assembly, with the translucent art disk 10, shown, as it would appear incased in the outside slide on ridged sleeve 8. The gap 19, between the round frame 8, and the oval suction cup frame 12 is shown, as it would appear before the apparatus is plumed to fit an aerodynamic automotive rear view window. The suction cup frame 12 holds the suction cup in place with the suction cup lip 16 visible from the front view.

Figure 5:
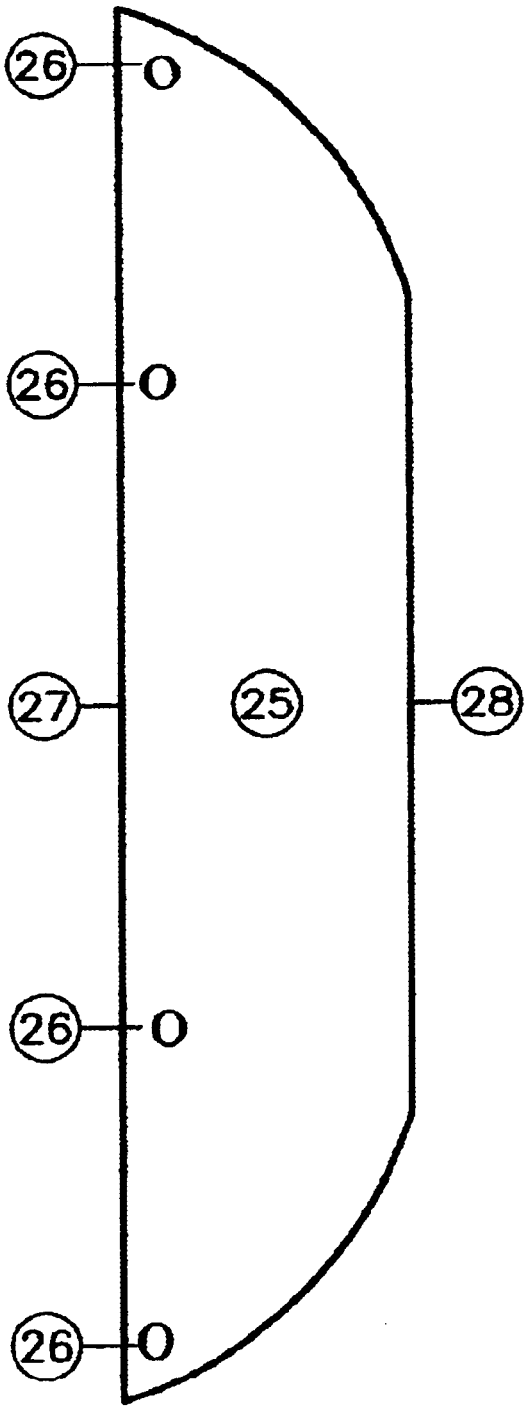
FIG. 5 is an embodiment of the snap on opaque sock.

FIG. 5 is simply the sock 25, which raps around the adjusted assembly when it is used in conjunction with a slanted aerodynamic automobile rear window. The sock has holes 26, along the straight edge 27, for snap on attachment to the outside slide on ridged sleeve. The sock has no holes along the curved edge 28.

KEY

1. Molded Plastic Assembly
2. Cylindrical Housing
3. Closed Wall
4. Centered Light Socket
5. Light Bulb
6. Interior Reflective Paint or Reflective Material
7. Open Ended Rigged Sleeve
8. Outside Slide on Ridged Sleeve
9. Loading Slot
10. Translucent Art Disk
11. Hinge
12. Oval Suction Cup Frame
13. Ridge for Suction Cup Application
14. Transparent Suction Cup
15. Suction Cup Face
16. Suction Cup Outer Lip
17. Suction Cup C Shaped Ridge
18. C Shaped Suction Cup Counter Ridge
19. Gap Between Round Frame Face and Oval Suction Cup Frame
20. Electric Wiring
21. On/Off Switch
22. Snap On Buttons
23. Flat Plastic Snap on Support Rod
24. Holes for Multi-Adjustments
25. Sock
26. Holes on Sock
27. Sock Straight Edge
28. Sock Curved Edge
29. Snap On Buttons at 90 Degree Angles for Sock Attachment
30. Gap for Sock
31. Non Adjustable Modified Sleeve
32. Aerodynamic Slanted Glass of Automobile Rear Window
33. Apparatus as it Appears in Rear Window of Automobile

What is claimed is:

1. An illuminated message display apparatus for an automobile window, and adaptable for any window display, comprising:

a molded plastic assembly comprised of a cylindrical housing; said housing has a closed wall consisting of a centered light socket and a light bulb, interior reflective paint or reflective material, and an open end with a ridged first sleeve on the perimeter thereof;

the first sleeve accepts a circular, slide-on second sleeve; the second sleeve has a first height, and has a loading slot for inserting translucent art disks; a hinge connects the second sleeve to an oval-shaped suction cup frame;

the suction cup frame has a second height, greater than said first height, and has a ridge spanning the outer circumference thereof, to which is attached a large, transparent suction cup;

the large transparent suction cup frames the entire open end of the housing, and allows for attachment to the interior automobile window surface; and means for selectively energizing said light bulb.

2. The illuminated message display apparatus of claim 1 having either a written message, religious symbol, athletic insignia, school mascot, business in combination with a translucent art disk, in which said disk has indicia displayed thereon.

3. The illuminated message display apparatus of claim 1 further has snap-on buttons on the second sleeve and on the suction cup frame aligned opposite the hinge; and a stabilizing support rod, which is lined with a series of holes to allow for multiple adjustments for snap-on assembly.

4. The illuminated message display apparatus of claim 1 further has an adjustable sock to entirely cover a gap created between the suction cup frame and the second sleeve when said suction cup frame is pivoted on said hinge for attachment to a sloped rear automobile window, thus impeding light from escaping from the display apparatus;

said suction cup frame having snap-on buttons attached thereto for attachment of the sock;

said sock covers the entire circumference of the apparatus at the location of the gap;

said sock having at least one edge lined with holes to accommodate said snap-on buttons.

5. The illuminated message display apparatus of claim 1 in which said transparent suction cup is comprised of a polymeric material of rubber, or rubber modified plastic, and is larger than the circumference of the entire cylindrical housing, first sleeve, second sleeve, and suction cup frame;

said transparent suction cup being flat and smooth and spanning the open end said housing, so as to create both an airtight membrane, and window, for light from said light bulb to radiate through.

* * * * *